US006796468B1

(12) United States Patent
Nideborn et al.

(10) Patent No.: US 6,796,468 B1
(45) Date of Patent: Sep. 28, 2004

(54) CARRYING HOLDER

(75) Inventors: Claes Nideborn, Borlange (SE); Anders Haglof, Borlange (SE)

(73) Assignee: Sacci Ryggöäckar AB (SE)

( * ) Notice: Subject to any disclaimer, the term of this patent is extended or adjusted under 35 U.S.C. 154(b) by 0 days.

(21) Appl. No.: 10/204,922

(22) PCT Filed: Feb. 23, 2000

(86) PCT No.: PCT/SE00/00360

§ 371 (c)(1),
(2), (4) Date: Oct. 30, 2002

(87) PCT Pub. No.: WO01/62120

PCT Pub. Date: Aug. 30, 2001

(51) Int. Cl.[7] ..... A45F 3/10
(52) U.S. Cl. ..... 224/266; 224/201
(58) Field of Search ..... 224/201, 265, 224/266, 271, 272

(56) References Cited

U.S. PATENT DOCUMENTS

| | | | | |
|---|---|---|---|---|
| 2,510,646 A | | 6/1950 | Meers | |
| 2,550,554 A | | 4/1951 | Griffin | |
| 2,873,645 A | * | 2/1959 | Horton | 352/34 |
| 2,893,672 A | | 7/1959 | Vardan | |
| 3,332,593 A | * | 7/1967 | Fauser | 224/185 |
| 4,244,500 A | * | 1/1981 | Fournier | 224/265 |
| 4,715,293 A | * | 12/1987 | Cobbs | 108/43 |
| 5,464,138 A | * | 11/1995 | Rodriguez | 224/265 |
| 5,573,158 A | * | 11/1996 | Penn | 224/265 |
| 5,749,010 A | * | 5/1998 | McCumber | 396/420 |
| 6,641,010 B2 | * | 11/2003 | Greene | 224/265 |

FOREIGN PATENT DOCUMENTS

| | | |
|---|---|---|
| FR | 1513528 | 1/1968 |
| FR | 2127412 | 10/1972 |
| SE | 9900494 | 8/2000 |

* cited by examiner

*Primary Examiner*—Stephen K. Cronin
(74) *Attorney, Agent, or Firm*—Obtrolenk, Faber, Gerb & Soffen, LLP

(57) ABSTRACT

The invention relates to a carrier hook device adapted to support relatively light articles, such as outdoor use computers, measuring instruments, control units, photographic equipment etc. in front of the body of the person using it, said hook (1) comprising a front portion (3) which extends in the longitudinal direction of the body from the belly upwards over the chest of the person and is adapted to secure the articles to be carried and, adjacent the neck (4) and above the chest, is integral with a rear portion (5) curving up over the shoulder and continuing downwards behind the head. The front portion (3) is located centrally over the chest and extends upwards over the shoulder at a predetermined distance from the neck, from there curving downwards behind the head along a distance allowing said rear portion (5) of the hook to extend downwards over and in contact with the shoulder blade of the carrier, said rear portion (5) exhibiting an anatomically shaped shoulder plate (6) in order to, to both shoulder blades and irrespective of the body shape, distribute the weight carried by the hook

10 Claims, 5 Drawing Sheets

CARRYING HOLDER

BACKGROUND OF THE INVENTION

The present invention relates to a carrier holder or hook device which is adapted to support relatively light articles, such as outdoor use computers, measuring instruments, control units, photographic equipment and the like, in front of the body of the person using it, said hook comprising a front portion which extends in the longitudinal direction of the body from the belly upwards over the chest of the person, is adapted to secure the articles to be carried and, adjacent the neck and above the chest, is integral with a rear portion curving up over the shoulder and continuing downwards behind the head.

The object of the present invention is to provide a carrier hook of such a design that relatively light articles can at the front of the body be carried in a simple and flexible way. Thanks to the anatomic configuration of the hook the carrying function will exhibit very good ergonomy but also good stability without stabilizing belts. The arrangements today available on the market and used for the same function are constituted by belts, harnesses or waistcoats and also by hook devices supported by the neck portion of the carrying person. The disadvantage of these hook equipments is that the weight of the articles which are to be carried with the aid of the hook produce pain in the neck portion. It has further been found that in the use of those prior art solutions it is difficult to reach an exact positioning of the articles carried at the front of the person. In addition thereto it is difficult to mount them.

SUMMARY OF THE INVENTION

Accordingly, the object of the present invention is to eliminate the disadvantages characterizing the prior art carrier arrangements with the aid of a carrier hook of the type mentioned above. It should in an excellent manner fullfill its purposes and at the same time be cheap and simple to manufacture. The features characterizing the invention are set out in the subsequent patent claims.

Thanks to the invention there has now been provided a carrier hook which can easily be put on and taken off and which, due to its shape matching the shape of the body, makes the major portion of the weight of the articles in contact with the chest or with the belly will be absorbed by the shoulder blades. This avoids loading of the soft parts of the body which are significantly more sensitive to load. With the aid of a flexible and/or articulated, anatomically shaped shoulder plate the weight can be equally distributed to both the shoulder blades irrespective of the body configuration of the carrying person. Further, the mounting of the shoulder plate at the hook can be made adjustable whereby the carrier hook can be better matched for use also by extremely big individuals. Thanks to this anatomic shape of the hook it can conveniently be used also by women. The length of the hook can be adjusted with the aid of a slide rail in order to match the hook to different back lengths. The torsional strength of the hook can be increased by providing it with longitudinal and transversal projections in its longitudinal direction.

The article to be carried can be secured to the front, lower portion of the hook either directly or via a belly plate in some convenient manner, e.g. with the aid of catches, buckles, ball joints etc. The article can be placed in an optimized position between an adjustable ball joint and a carrier arm so that an ergonomic working position is attained. Maximum comfort and increased friction against the body parts in contact with the plates can be established by covering the plates with a woven material, felt, rubber, foam plastic or any other suitable material.

Preferably, the carrier hook is manufactured in vacuum shaped or injection moulded plastic, alternatively in pressed aluminium or steel sheet. During the injection moulding in different plastic materials it can also be provided with transverse ribs, made flexible in the deep direction, to attain maximum matching to different anatomic body shapes.

BRIEF DESCRIPTION OF THE DRAWINGS

Some preferred embodiments of the invention are described below, reference being made to the drawings.

DESCRIPTION OF THE PREFERRED EMBODIMENT

Figure 1:
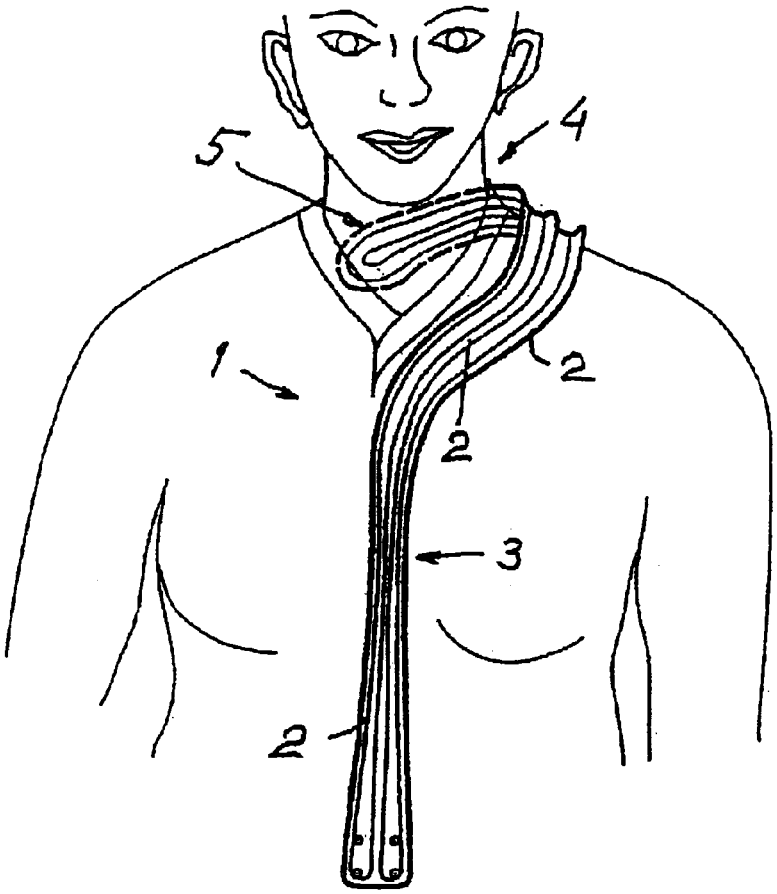
FIG. 1 illustrates a first embodiment of a carrier hook according to the invention, shown before the application of the article to be carried in front of the chest.
Figure 4:
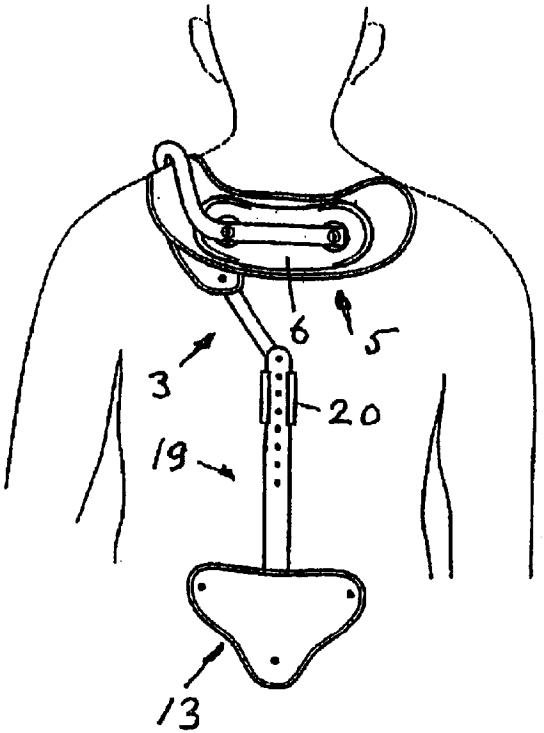
FIG. 4 illustrates the hook shown in FIGS. 2 and 3 as seen in a rear view and mounted on a carrier indicated in dotted lines.
Figure 3:
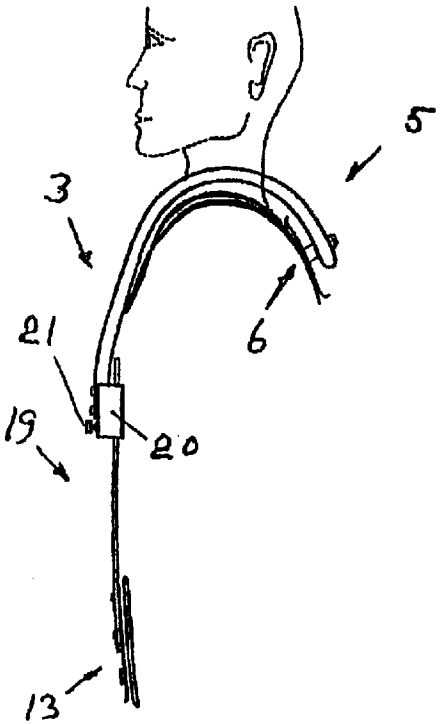
FIG. 3 is a lateral view of the embodiment shown in FIG. 2.
Figure 2:
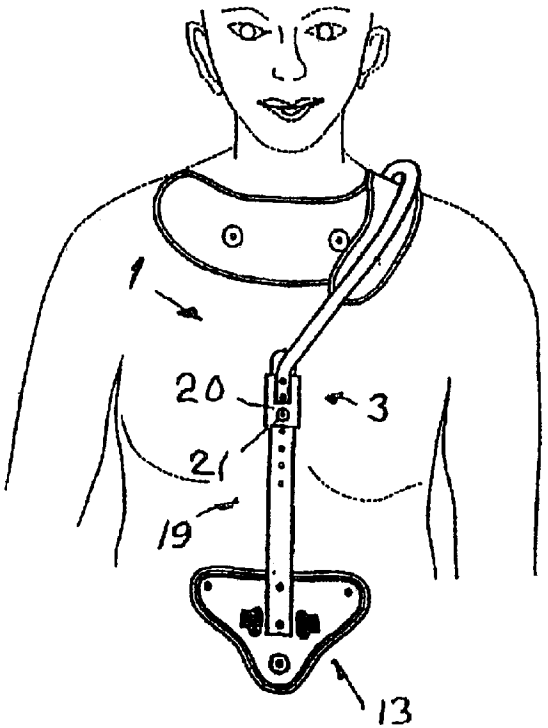
FIG. 2 illustrates an alternative embodiment of the invention as seen in a front view. It includes a belly plate which shall receive the articles to be carried and which can be adjusted in the height direction with the aid of a slide rail.

As has more in detail been shown in FIG. 1 it does illustrate a first embodiment of a hook 1 according to the invention which has been manufactured in a vacuum form or injection moulded plastic or in a pressed aluminium or steel sheet material. In order to increase the torsional stiffness of the hook it has longitudinal ridges or profiles 2. The hook 1 does also include a centrally front portion extending over the chest in the longitudinal direction from the belly and upwards to receive the articles which are to be carried. The front portion 3 curves upwards shortly the neck 4 and above the chest up over the shoulder at a predetermined distance from the neck, then to continue curving down behind the head of the carrying person a distance allowing a rear portion 5 of the hook to extend down over and in contact with the shoulder blades. In this way the overall weight of the hook including the equipment carried by it can be supported in such a manner that the weight is taken up via the shoulder blades without any pressure being excerted against the sensitive soft parts of the body.

Figure 5:
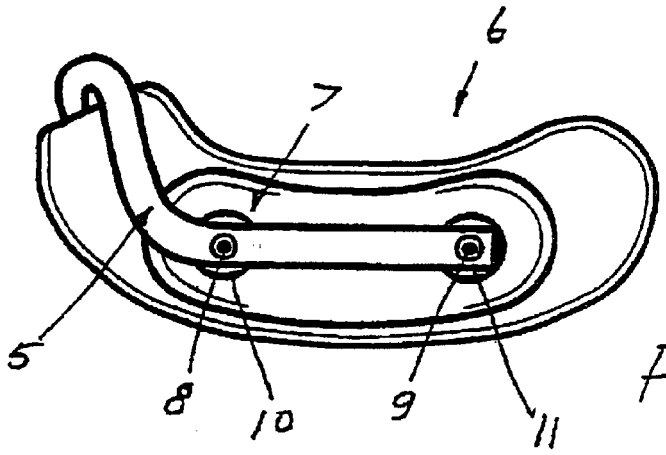
FIG. 5 shows a first embodiment of an anatomically shaped shoulder plate secured to the rear portion of the carrier hook.
Figure 6:
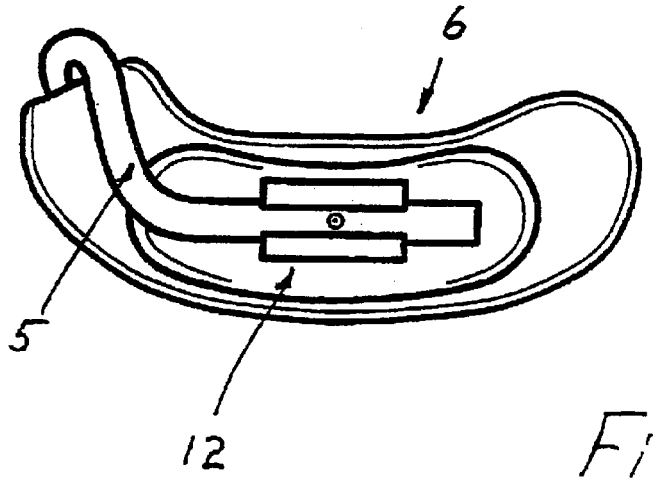
FIG. 6 is an alternative embodiment of the shoulder plate shown in FIG. 5.

According to the embodiment shown more in detail in FIGS. 5 and 6 the rear portion 5 of the hook 1 is constituted by an anatomically shaped shoulder plate 6 distributing the weight loading the hook 1 in such a way that both shoulder blades will absorb the weight irrespective of the body configuration of the carrying person. The connection between the shoulder plate 6 and the rear portion 5 of the hook 1 is adjustable, so that the distance between the shoulder plate 6 and the hook 1 can be varied.

The shoulder plate 6 can in a flexible or articulated way be attached to the rear portion 5. To provide the mentioned flexibility use can be made of a rubber bushing, a ball joint, one or more horizontally mounted clips or a hinge 7. FIGS. 5 and 6 illustrate the connection between the shoulder plate 6 and the rear portion 5 of the hook. According to the embodiment shown in FIG. 5 the shoulder plate 6 is attached to the rear portion 5 in two points 8 and 9 which include rubber bushings 10 and 11. According to the embodiment shown in FIG. 6 the shoulder plate 6 is attached by means of a horizontally mounted clip 12 in order to increase the lateral stability of the hook 1. Further, according to an alternative embodiment, the rear portion 5 can have a tapered portion supporting and stabilizing the hook 1 against the shoulder area of the carrier.

Figure 7:
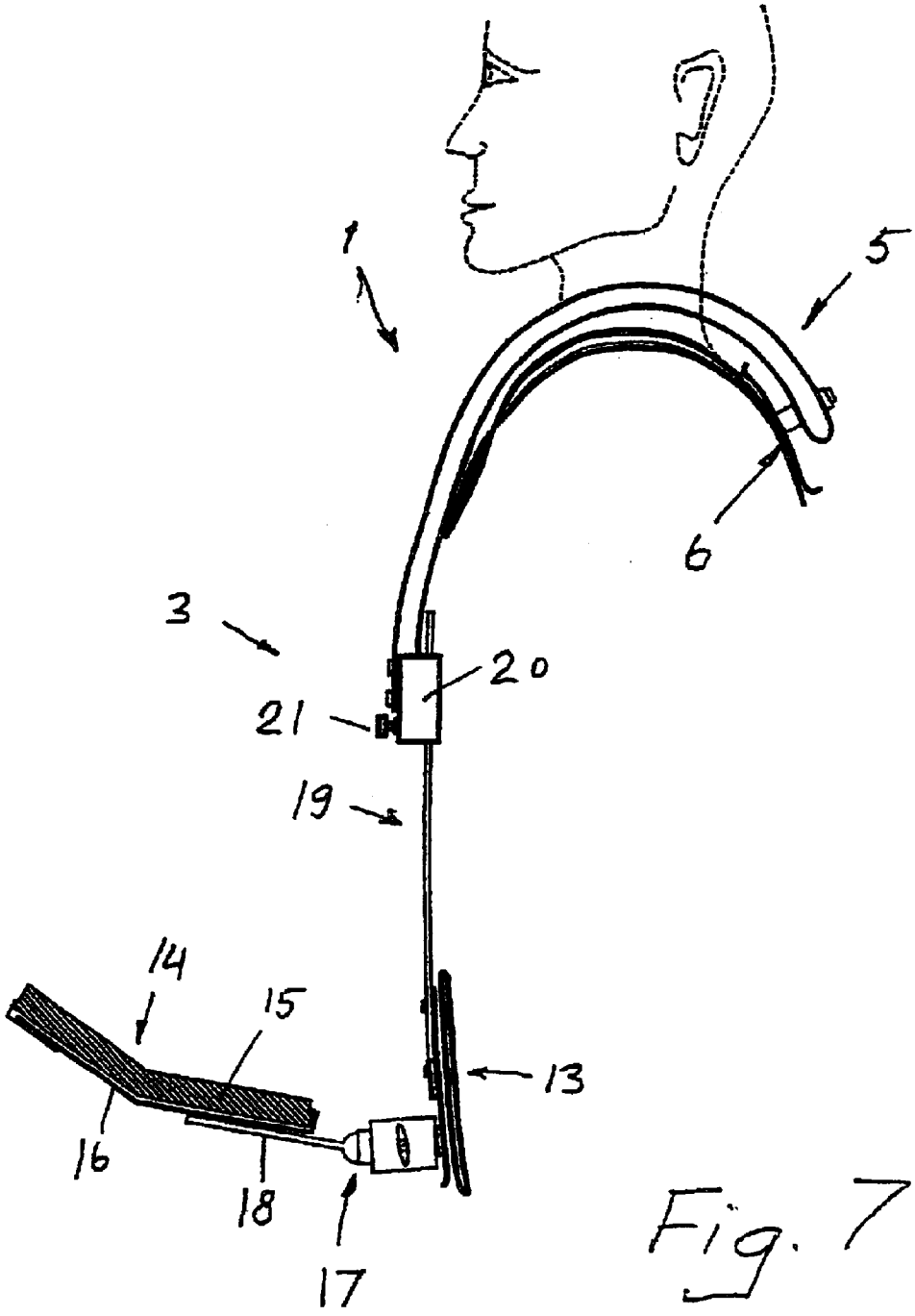
FIG. 7 illustrates the carrier hook according to the invention shown in a lateral view and mounted on a carrier. In this example the hook does via its belly plate, support an outdoor use computor.
Figure 8:
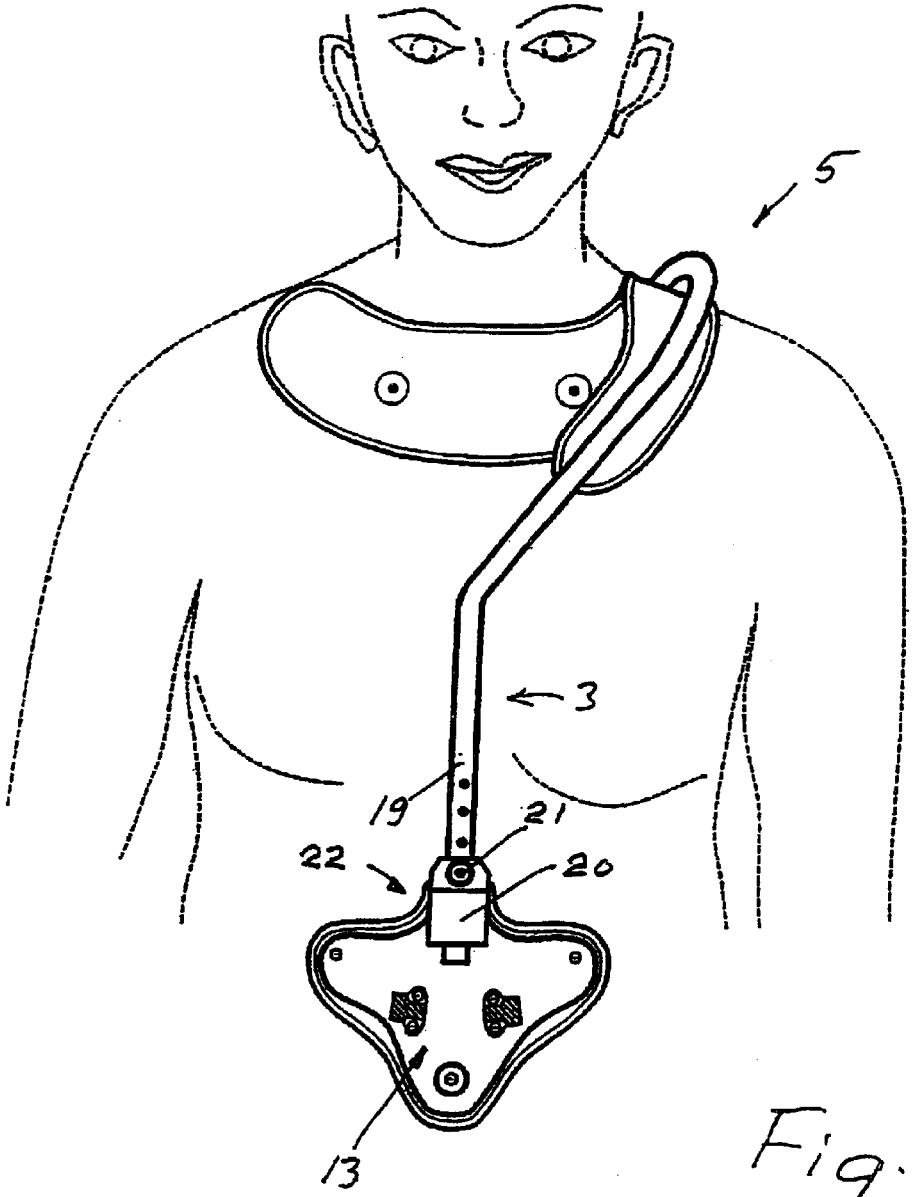
FIG. 8 is a front view showing a modification of the embodiment of FIG. 7.

Thanks to the flexibility and the variable connection at its front the hook 1 can match different body configurations. The front portion 3 of the hook 1 includes a magnetic plate 13 the purpose of which is in its turn to carry the equipment 14 which, according to the example shown in FIG. 7, is constituted by an outdoor use computor 15 which via a support plate 16 with a support arm 18 can, with the aid of a ball joint 17, be adjusted relatively the belly plate 13. This arrangement offers an ergonomic working position which facilitates use of the computor 15. The lenght of hook 1 can be adjusted by means of a slide rail 19 via a mounting 20 having a locking screw or a resilient locking pin 21. The mounting 20 is secured to the front portion 3 of hook 1 or to the upper portion 22 of belly plate 13 as shown in FIG. 8. This provides a simple vertical adjustment of the computor 15 as called for by different back-dimensions. The hook 1 according to the invention can be further stabilized with the aid of an adjustable waist belt attached to the belly plate.

What is claimed is:

1. A carrier hook device adapted to support relatively light articles, in front of a body of a person using it, the hook comprising a front portion which extends from a belly and upwards over a chest of the person, the front portion is adapted to secure an article to be carried and, a rear portion integral with the front portion adjacent a neck and above a chest of the person, the rear portion curving up over a shoulder of the person and continuing downwards behind a head of the person, the front portion is located centrally over the chest and extends upwards over the shoulder at a predetermined distance from the neck, the hook curving downwards behind the head along a distance allowing the rear portion of the hook to extend downwards, over and in contact with a shoulder-blade of the person, the rear portion supporting an anatomically shaped shoulder plate extending to both shoulder-blades and irrespective of the body shape of the person, the shoulder blade distributing the weight carried by the hook and the article thereon being supported via the shoulder-blades without exercising any pressure against load-sensitive soft parts of the body of the person.

2. Carrier hook according to claim 1, wherein the shoulder plate is separate from and is flexibly or articulatedly mounted at the rear portion.

3. Carrier hook according to claim 2, further comprising a joint between the rear portion and the shoulder plate, and the joint comprising a rubber bushing or by a hinge.

4. Carrier hook according to claim 2, wherein the shoulder plate is adjustably connected with the front portion of the hook, and the distance between the shoulder plate and the hook is variable.

5. Carrier hook according to claim 2, further comprising an articulated connection of the shoulder plate to the rear portion of the hook, which includes two attachment points in order to increase the lateral stability of the hook.

6. Carrier hook according to claim 2, further comprising an articulated connection of the shoulder plate to the rear portion of the hook, which includes a transverse joint in order to increase the lateral stability of hook.

7. Carrier hook according to claim 1, wherein the front portion includes a belly plate for distributing the pressure against the belly and adapted to support the article.

8. Carrier hook according to claim 7, further comprising a slide rail support, the belly plate of the front portion is vertically adjustable along the slide rail to match different back length dimensions of the carrier.

9. Carrier hook according to claim 7, wherein the belly plate includes a support arm for the article.

10. Carrier hook according to claim 9, further comprising a ball joint between the support arm and the belly plate.

* * * * *

UNITED STATES PATENT AND TRADEMARK OFFICE

CERTIFICATE OF CORRECTION

PATENT NO. : 6,796,468 B1 
DATED : September 28, 2004
INVENTOR(S) : Claes Nideborn and Anders Haglof It is certified that error appears in the above-identified patent and that said Letters Patent is hereby corrected as shown below:

Title page,
Item [73], Assignee, should read -- Sacci Ryggsäckar AB (SE) --

Signed and Sealed this

Twenty-first Day of December, 2004

JON W. DUDAS
*Director of the United States Patent and Trademark Office*